US005732307A

United States Patent [19]

Yoshizuka et al.

[11] Patent Number: 5,732,307

[45] Date of Patent: Mar. 24, 1998

[54] IMAGING APPARATUS HAVING AN IMAGING OPERATION CONTROLLED IN COORDINATION WITH A SHEET STORAGE OPERATION

[75] Inventors: Ken Yoshizuka; Katsuji Furushige, both of Osaka, Japan

[73] Assignee: Mita Industrial Co., Ltd., Osaka-fu, Japan

[21] Appl. No.: 610,508

[22] Filed: Mar. 4, 1996

[30] Foreign Application Priority Data

Mar. 6, 1995 [JP] Japan ..... 7-045791

[51] Int. Cl.[6] ..... G03G 15/00

[52] U.S. Cl. ..... 399/23; 271/110; 271/153; 271/155; 399/393

[58] Field of Search ..... 399/23, 45, 43, 399/388, 393, 391, 361; 271/153, 258.02, 265.01, 9.03, 152, 155, 110, 111, 145

[56] References Cited

U.S. PATENT DOCUMENTS

| | | | |
|---|---|---|---|
| 4,484,734 | 11/1984 | Tsudaka et al. | 271/9.03 |
| 4,763,889 | 8/1988 | Dei et al. | 271/9.03 |
| 4,974,019 | 11/1990 | Nishioka et al. | 271/9.03 X |
| 5,177,545 | 1/1993 | Kato et al. | 271/155 X |
| 5,347,350 | 9/1994 | Nakahata et al. | 399/393 X |
| 5,397,118 | 3/1995 | Iida et al. | 271/155 |

FOREIGN PATENT DOCUMENTS

| | | | |
|---|---|---|---|
| 63-71034 | 3/1988 | Japan | 271/110 |

*Primary Examiner*—S. Lee
*Attorney, Agent, or Firm*—Jordan and Hamburg

[57] ABSTRACT

An image forming apparatus has an imaging portion; a sheet storage portion including a sheet support member on which a stack of copy sheets are placed, the sheet support member being movable between a sheet replenishing position where copy sheets are replenished and a sheet dispense position where copy sheets are dispensed to the imaging portion one by one; a detector which detects the presence of the sheet support member at the sheet dispense position; a instructing portion which instructs an imaging operation to the imaging portion; and a controller which holds the instruction of imaging operation during a movement of the sheet support member from the sheet replenishing position to the sheet dispense position after receiving the instruction until the sensor detects that the sheet support member has reached the sheet dispense position and which controls the imaging portion to start the imaging operation upon the sensor detecting that the sheet support member has reached the sheet dispense position. Even if the sheet support member is on the way from the sheet replenishing position to the sheet dispense position, the instruction of imaging operation by the instructing portion is allowed.

5 Claims, 5 Drawing Sheets

IMAGING APPARATUS HAVING AN IMAGING OPERATION CONTROLLED IN COORDINATION WITH A SHEET STORAGE OPERATION

BACKGROUND OF THE INVENTION

This invention relates to an image forming apparatus provided with a sheet storage portion and having an improved workability in imaging operation instruction after being replenished with copy sheets.

Generally, an image forming apparatus is operated in such a manner that: a toner image formed in an imaging portion including a photosensitive member is transferred onto a sheet of copy paper being fed from a sheet storage portion to a specified position corresponding to the photosensitive member in a transferring portion; and the copy sheet having the toner image transferred thereon is separated from the photosensitive member in a separating portion, has the toner image fixed thereon in a fixing portion, and is discharged from the image forming apparatus.

Conventionally, there have been known image forming apparatus comprising a sheet storage portion provided with a deck portion in which a sheet support member is movable upward and downward between a sheet dispense position and a sheet replenishing position and an uppermost copy sheet of a stack of copy sheets placed on the sheet support member is fed to a main body of the image forming apparatus when the sheet support member is moved upward to the sheet dispense position. In such image forming apparatus, when the deck portion runs short of copy paper, the sheet support member is automatically moved downward and stopped at the specified sheet replenishing position where the deck portion is replenished with copy sheets. After the deck portion is replenished with copy sheets and a cover for the deck portion is closed, the sheet support member is automatically moved upward. When reaching the specified sheet dispense position where the uppermost copy sheet is fed to the apparatus main body, the sheet support member is stopped to enable instruction of a print start key.

The above image forming apparatus has suffered the following problems. Since the apparatus is not ready to start an imaging operation, i.e., not able to instruct a print start immediately after the deck portion is replenished with copy sheets, an operator is required to wait for a specified time until the sheet support member is completely moved upward to the sheet dispense position to depress the print start key for the print start instruction. This obstructs the operator from performing other tasks during the upward movement of the sheet support member and lowers the workability of the operator.

SUMMARY OF THE INVENTION

It is an object of the present invention to provide an image forming apparatus which has overcome the problems residing in the prior art.

It is another object of the present invention to provide an image forming apparatus which can allow the instruction of a print start key immediately after sheet replenishment.

The present invention is directed to an image forming apparatus comprising: an imaging portion; a sheet storage portion including a sheet support member on which a stack of copy sheets are placed, the sheet support member being movable between a sheet replenishing position where copy sheets are replenished and a sheet dispense position where copy sheets are dispensed one by one to the imaging portion;

a detector which detects the presence of the sheet support member at the sheet dispense position; an instructing portion which instructs an imaging operation to the imaging portion; and a controller which holds the instruction of imaging operation during a movement of the sheet support member from the sheet replenishing position to the sheet dispense position after receiving the instruction until the detector detects that the sheet support member has reached the sheet dispense position and controls the imaging portion to start the imaging operation upon the detector detecting that the sheet support member has reached the sheet dispense position.

The image forming apparatus may be further provided with a sheet sensor which detects the presence or absence of copy sheet on the sheet support member, wherein the controller inhibits start of the imaging operation when the sheet sensor detects the absence of copy sheet on the sheet support member.

The sheet storage portion may be provided with a plurality of sheet support members. In this case, the image forming apparatus may be preferably further provided with a selector which selectively selects a particular sheet support member among the plurality of sheet support members. The controller holds the instruction of imaging operation during a movement of the selected sheet support member from the sheet replenishing position to the sheet dispense position after receiving the instruction until the detector detects that the sheet support member has reached the sheet dispense position, and controls the imaging portion to start the imaging operation upon the detector detecting that the sheet support member has reached the sheet dispense position.

With this arrangement, the apparatus is allowed the instruction of imaging operation of the instructing portion even during the movement of the sheet support member from the sheet replenishing position to the sheet dispense position. After receiving the instruction from the instructing portion and it is detected that the sheet support member has reached the sheet dispense position, the imaging operation is started. Accordingly, there is no need of waiting for the imaging operation instruction by the instructing portion until the sheet support member reaches the sheet dispense position. Thus, an operator can instruct the imaging operation with the instructing portion during the movement of the sheet support member from the sheet replenishing position to the sheet dispense position to perform other tasks during the movement of the sheet support member. Accordingly, the user can have more time to perform other operations, thus improving his/her work conditions.

In the case where the sheet support member does not carry a stack of copy sheets thereon, an imaging operation start is inhibited even if the instructing portion instructs the imaging operation. Accordingly, erroneous imaging operation can be prevented.

Further, in the case of image forming apparatus having a plurality of sheet support members, when an imaging operation is instructed by the instructing portion during the movement of a selected sheet support member to the sheet dispense position, it is checked that the selected sheet support member has reached the sheet dispense position, and the imaging operation is started after the detection of the arrival. Accordingly, even in the image forming apparatus having a plurality of sheet support members, the time of the user for copy operation will be considerably reduced.

Further, an imaging operation is started immediately after the detection regardless of whether non-selected sheet support members are at their respective sheet dispense positions. Accordingly, there is no need of waiting for the imaging operation instruction until a non-selected sheet support member reaches the sheet dispense position. Moreover, the imaging operation for copy sheets stacked on the selected particular sheet support member which has moved upward to the sheet dispense position can be started immediately after the detection. Accordingly, the working efficiency of the user can be further increased.

The above and other objects, features and advantages of the present invention will become more apparent upon a reading of the following detailed description and drawings.

DETAILED DESCRIPTION OF THE PREFERRED EMBODIMENTS OF THE INVENTION

Figure 4:
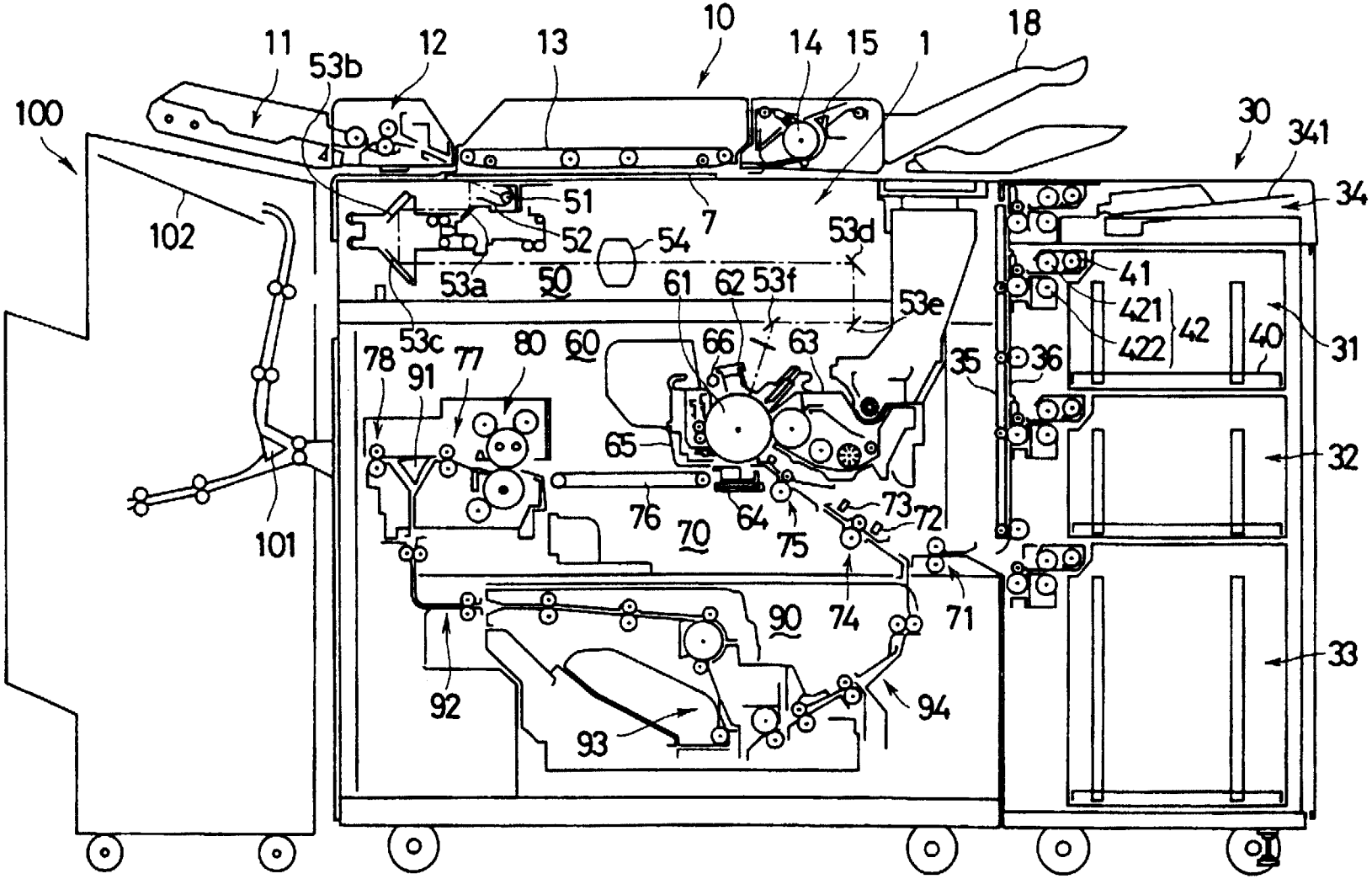
FIG. 4 is a front view showing an internal construction of this embodiment.

A schematic construction of an inventive image forming apparatus is described with reference to the accompanying drawings. FIG. 4 is a front view showing an internal construction of the image forming apparatus.

The image forming apparatus comprises a main body 1, a document transport unit 10, a copy sheet storage portion 30 arranged in a right side thereof, and a sorter 100 arranged in a left side thereof. The document transport unit 10 is arranged in a top portion of the apparatus main body 1 and is also used as a document holder.

The main body 1 comprises a document glass plate 7 at a center on a top surface thereof, and an operation display panel 200 (see FIG. 1) at a front end of the top surface. The main body 1 of the image forming apparatus is internally provided with an optical system 50, an imaging assembly 60, a sheet transport assembly 70, a fixing unit 80, and a duplex copy portion 90.

The document transport unit 10 comprises a document placing portion 11, a document transport driving portion 12 including a pair of document transport rollers, a document transport belt 13, a document discharge roller 14, a document inverting portion 15, and a document discharge tray 18. Documents placed on the document placing portion 11 are automatically transported to a specified position on the document glass plate 7 one by one and temporarily stopped thereat. After an image of the document placed on the document glass plate 7 is exposed to light and scanned, the document is discharged onto the discharge tray 18. The image forming apparatus has a duplex copying function. When the duplex copying function is used, after an image of one side of the document is exposed to light and scanned, the document has its transport direction inverted by a switching operation of the inverting portion 15 and is placed again on the document glass plate 7 in an inverted state to have an image on the other side of the document scanned.

The optical system 50 comprises a light source including an exposure lamp 51 and a reflector 52, mirrors **53*a*, 53*b*, 53*c*, 53*d*, 53*e*, 53*f*, and a lens unit 54. The light source and the mirrors 53*a*, 53*b*, 53*c*** are reciprocally movable in sideways directions of the apparatus at a specified speed. A document image is scanned by the reciprocal movement of the light source and the mirrors to thereby form an optical image of the document image.

The imaging assembly 60 includes a photosensitive member 61 in the form of a drum. The photosensitive drum 61 is rotatably supported. The imaging assembly 60 is further arranged with a main charger 62, a developing unit 63, a transferring/separating unit 64, a cleaning unit 65, and a blank lamp 66 in the periphery of the photosensitive drum 61 along a rotational direction of the photosensitive drum 61 in this order. The main charger 62 uniformly charges a surface of the photosensitive drum 61 at a specified potential. A specified area of the surface of the photosensitive drum 61 right downstream of the main charger 62 is exposed, and an optical image of a document introduced to the drum surface is exposed at the surface area of the photosensitive drum 61 to thereby form an electrostatic latent image thereon. The electrostatic latent image is developed into a toner image by the developing unit 63 by electrically attracting toner particles to the charged latent image. The transferring/separating unit 64 transfers the toner image developed on the drum surface onto a copy sheet which is transported to the surface of the photosensitive drum 61 as timed with the developing process, and separates the copy sheet carrying the toner image from the surface of the photosensitive drum after the image transfer process. The cleaning unit 65 removes toner particles remaining on the surface of the photosensitive drum 61. The blank lamp 66 removes unnecessary electric charges remaining on the drum surface.

The sheet transport assembly 70 comprises a pair of sheet transport rollers 71, a pair of sheet feeding rollers 74, a pair of sheet registration rollers 75, a sheet transport belt 76, a fixing unit 80, a pair of sheet transport rollers 77, and a pair of sheet discharge rollers 78 along the sheet transport direction in this order. The sheet transport roller pair 71 transports a copy sheet dispensed from the sheet storage portion 30 toward the photosensitive drum 61. The registration roller pair 75 is driven as timed with a scanning timing of the optical system 50. The transport belt 76 transports the copy sheet separated from the photosensitive drum 61 to the fixing unit 80 where a toner image transferred to the copy sheet is fixed. The transport roller pair 77 transports the copy sheet after the fixing process downstream. The discharge roller pair 78 discharges the thus transported copy sheet to the sorter 100.

Switches 72 and 73 are arranged at the upstream side and downstream side of the feeding roller pair 74, respectively. The switch 72 is adapted for detecting the copy sheet which is transported by the feeding roller pair 74, while the switch 73 is adapted for detecting the copy sheet which is transported further downstream by the registration roller pair 75.

Between the sheet transport roller pair 77 and the sheet discharge roller pair 78 arranged is a junction 91 for selectively transporting the copy sheet to the sorter 100 or to the duplex copy portion 90.

A copy sheet for a duplex copying is selectively transported to the duplex copy portion 90 by the junction 91, guided along a sheet transport inlet 92 and temporarily stored in a sheet inverting portion 93. Then, the copy sheet temporarily stored in the sheet inverting portion 93 is guided again to the photosensitive drum 61 via a sheet transport outlet 94.

The sorter 100 comprises a junction 101, an unshiftable bin tray 102 and unillustrated shiftable bin trays for sorting out sheets of copy paper after an imaging operation. By selectively switching the junction 101, the copy sheet or sheets after an imaging operation is or are discharged onto the bin tray 102 or the unillustrated bin trays for sorting. The sorter 100 includes an unillustrated bin trays elevating mechanism. The bin trays elevating mechanism shifts the unillustrated bin trays one after another upward or downward as timed with a discharging operation of copy sheets from the apparatus main body 1 to discharge the copy sheets onto the bin trays one by one.

Figure 2A:
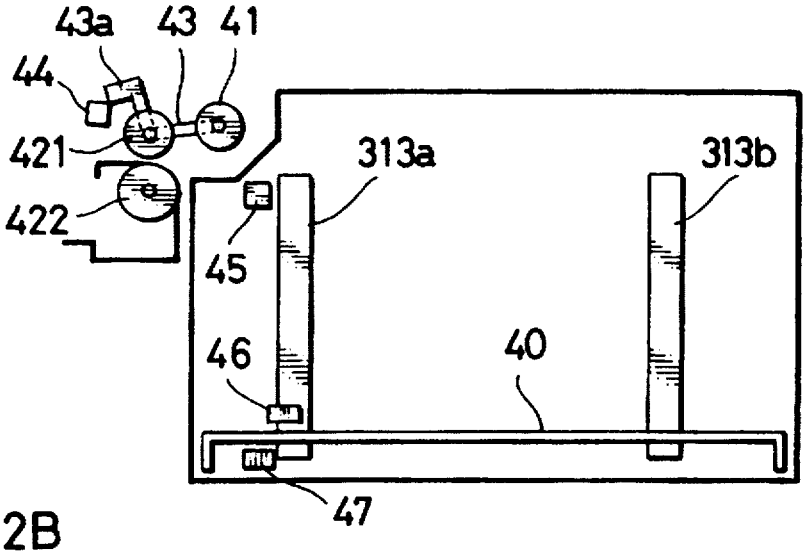
FIGS. 2A and 2B are diagrams of a construction of a deck portion, FIG. 2A showing a state that a sheet support member is in a sheet replenishing position, and FIG. 2B showing a state that the sheet support member is in a sheet dispense position.
Figure 2B:
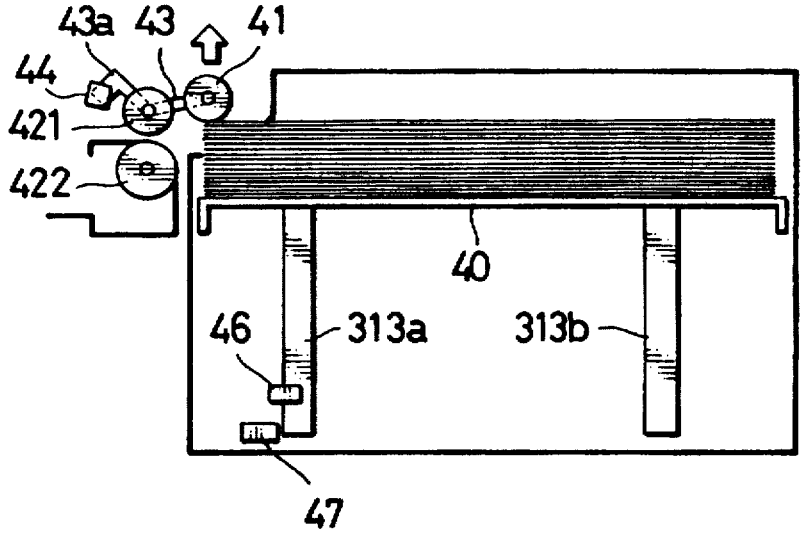
Figure 3:
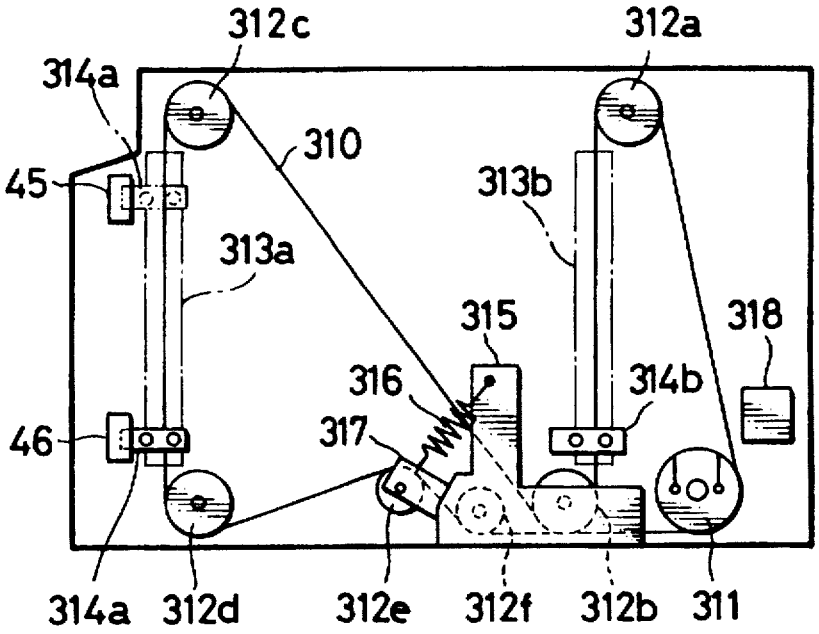
FIG. 3 is a diagram of an elevating mechanism of the sheet support member.

The construction of the sheet storage portion 30 will be described with reference to FIGS. 2 to 4.

The sheet storage portion 30 comprises deck portions 31, 32, and 33, and a manual insertion portion 34. The manual insertion portion 34 includes a manual insertion tray 341. Copy sheets placed on the manual insertion tray 341 are fed through the manual insertion portion 34 to the apparatus main body one by one. Since the deck portions 31, 32, and 33 have the construction identical to one another, the construction of the deck portion is described with reference to the deck portion 31, while the description on the construction of the deck portions 32 and 33 will be omitted.

The deck portion 31 is internally provided with a sheet support member 40 for supporting a stack of copy sheets of a specified size in a vertical alignment manner. The sheet support member 40 is in the form of a plate. The sheet support member 40 is made vertically movable between a sheet dispense position (first position) where the stacked copy sheets are dispensed one by one to the main body 1 and a sheet replenishing position (second position) where the deck portion is replenished with copy sheets when the deck portion runs short of copy sheets. The sheet dispense position is located at an upper position of the deck portion, while the sheet replenishing position is located at a lower position of the deck portion. When the sheet support member 40 is at the sheet dispense position and an uppermost copy sheet of the stacked copy sheets comes into contact with a rotating feeding roller 41, the copy sheet is fed to the apparatus main body. Thus, the copy sheets stacked on the sheet support member are fed to the apparatus main body one by one.

The deck portion 31 is provided with an unillustrated cover at a front surface thereof. The deck portion 31 includes a sheet replenishment instruction switch 48 (see FIG. 1) at an appropriate position in the vicinity of the cover to instruct the sheet support member 40 to move downward to the sheet replenishing position, and a cover sensor adapted for detecting the opening or closing of the cover. The cover is openable only when the sheet support member 40 is at the sheet replenishing position. The deck portion 31 is replenished with copy sheets by opening the cover and withdrawing the deck portion 31 forward and placing a stack of copy sheets from above onto the sheet support member 40.

An example of an elevating mechanism for the sheet support member 40 is described with reference to FIG. 3. It should be appreciated that the elevating mechanism in FIG. 3 is provided at front and rear sides of the deck portion 31 in FIG. 4 and these elevating mechanisms have the construction substantially identical to each other.

A wire 310 is stretched around a front (rear) drive pulley 311, front (rear) pulleys 312*a*, 312*b*, 312*c*, 312*d*, 312*e*, and 312*f* in such a manner that both ends thereof are secured to the front (rear) drive pulley 311. A front fixing member 314*a* is attached to the wire at an appropriate position between the front pulleys 312*c* and 312*d* and a rear fixing member 314*b* is attached to the wire at an appropriate position between the rear pulleys 312*a* and 312*b*.

The pulley 312*e* is rotatably mounted to one end of a support plate 317 in a lengthwise direction thereof. The support plate 317 has an end rotatably mounted on a lower end of a base block 315 which is fixedly secured to a main body of the sheet storage portion, and has a side connected to an upper end of the base block 315 via a helical spring 316 to be biased slantingly upward. The pulley 312*e* applies a specified tension to the stretched wire 310.

The sheet support member 40 is securely mounted on the fixing members 314*a* and 314*b*. Specifically, the sheet support member 40 is supported by the respective front and rear fixing members.

The front and rear drive pulleys 311 are provided with a common drive shaft. The drive shaft is coupled to a drive shaft of a lifting motor 318 by an unillustrated driving force transmission mechanism. The lifting motor 318 is rotatable forward and backward and allows the sheet support member 40 to be lifted upward and downward by switching the moving direction of the wire 310.

Guide grooves 313*a* and 313*b* are formed at an appropriate position in the main body of the sheet storage portion over the moving range of the fixing members 314*a* and 314*b*. A projection formed at the wire mounting portions 314*a* and 314*b* is engaged with the guide grooves 313*a* and 313*b* to slidingly guide the sheet support member 40 upward and downward.

A sheet replenishing position sensor 46 is arranged at a specified position near a lower end of the guide groove 313*a*. The sheet replenishing position sensor 46 is a photointerrupter comprising, e.g., a light emitting portion and a photoreceptor which are opposed to each other at a specified clearance. The sheet replenishing position sensor 46 is arranged such that the clearance is located on the moving path of the fixing member 314*a*. When the fixing member 314*a* comes across the clearance on the moving path to thereby interrupt the optical path of the light emitting portion, the sensor 46 detects that the sheet support member 40 is at the sheet replenishing position.

A sheet shortage sensor 45 is arranged at a specified position in an upper portion of the groove 313*a* apart from the sensor 46 at a specified distance. The sheet shortage sensor 45 is a photointerrupter comprising, e.g., a light emitting portion and a photoreceptor which are opposed to each other at a specified clearance. The sensor 45 is arranged such that the clearance is located on the moving path of the fixing member 314*a*. When the fixing member 314*a* comes across the clearance on the moving path to thereby interrupt the optical path of the light emitting portion, the sensor 45 detects that the deck portion runs short of copy sheets.

The construction of the deck portion 31 except the elevating mechanism of the sheet support member 40 is described with reference to FIGS. 2 and 4.

The sheet support member 40 is formed with a hole (not shown) of a specified size at an appropriate position thereof. A sheet sensor 47 is arranged below the hole. The sheet sensor 47 is a reflective type photosensor comprising, e.g., a light emitting portion and a photoreceptor. When light emitted from the light emitting portion comes through the hole and is reflected by a copy sheet placed on the sheet support member 40, the reflected light is received by the photoreceptor, thereby detecting the presence of copy sheet.

The feeding roller 41 is arranged at an appropriate position of an upper portion of the deck portion 31. A pair of separation rollers 42 comprising a forward roller 421 and a reverse roller 422 are arranged in the left side of the feeding roller 41, i.e., on the side of the apparatus main body 1. When the feeding roller 41 comes into contact with a leading end of an uppermost copy sheet of copy sheets stacked on the sheet support-member 40, the uppermost copy sheet is fed out to the apparatus main body by the feeding roller 41 and the separation roller pair 42. Thus, the stacked copy sheets are fed to the apparatus main body one by one.

The feeding roller 41 is rotatably supported about a rotatable shaft of the forward roller 421. Specifically, as shown in FIGS. 2A and 2B, a lever 43 is connected with the forward roller 421 and the feeding roller 41. When an uppermost copy sheet of copy sheets stacked on the sheet support member 40 comes into contact with the feeding roller 41, the feeding roller 41 is moved upward, i.e., in a counterclockwise direction with the aid of the lever 43. Accordingly, the feeding roller 41 is rotated in a specified range in the counterclockwise direction from a stationary position. The lever 43 includes a detecting piece **43*a*. The detecting piece 43*a* extends from the end of the lever 43 which is opposite to the end connected to the feeding roller 41. Accompanied by the movement of the feeding roller 41, the detecting piece 43*a* swings about the axis of the forward roller 421**.

A sheet dispense position sensor 44 is a photointerrupter comprising e.g., a light emitting portion and a photoreceptor which are opposed to each other at a specified clearance. The sheet dispense position sensor 44 is arranged near the forward roller 421 so that the clearance is located on the moving path of the detecting piece **43*a*. When the detecting piece 43*a* comes across the clearance of the moving path to thereby interrupt the optical path of the light emitting portion, the sensor 44 detects that the sheet support member 40** is at the sheet dispense position.

With this construction, when the sheet support member 40 is gradually lifted upward as the deck portion runs short of copy sheets, and the fixing member **314*a* finally comes across the clearance of the sheet shortage sensor 45, thereby interrupting the optical path of the sensor 45, the sensor 45 detects that the deck portion runs short of copy sheets. At which level the sensor 45 detects that the deck portion runs short of copy sheets is determined by the position of the sensor 45. For example, the sensor 45 may be positioned at such a level that the sensor detects the shortage of copy sheet when about 100 sheets of copy paper are left on the sheet support member 40**.

Further, when the sheet support member 40 is lifted downward, and the fixing member **314*a* comes across the clearance of the sheet replenishing position sensor 46, thereby interrupting the optical path of the sensor 46, the sensor 46 detects that the sheet support member 40** comes down to the sheet replenishing position.

On the other hand, as mentioned above, when the uppermost copy sheet of the stacked copy sheets lifts the feeding roller 41 upward as the upward movement of the sheet support member 40, thereby rotating the lever 43 in the counterclockwise direction, the detecting piece **43*a* comes across the clearance of the sheet dispense position sensor 44, thereby interrupting the optical path of the sensor 44. At this time, the sensor 44 detects that the sheet support member 40** comes up to the sheet dispense position.

A copy sheet dispensed from the deck portions 31, 32 and the manual insertion portion 34 is guided along a transport path defined by transport guide portions 35 and 36 and transported to the transport roller pair 71 of the apparatus main body 1. A copy sheet dispensed from the deck portion 33 is directly transported to the transport roller pair 71.

Figure 1:
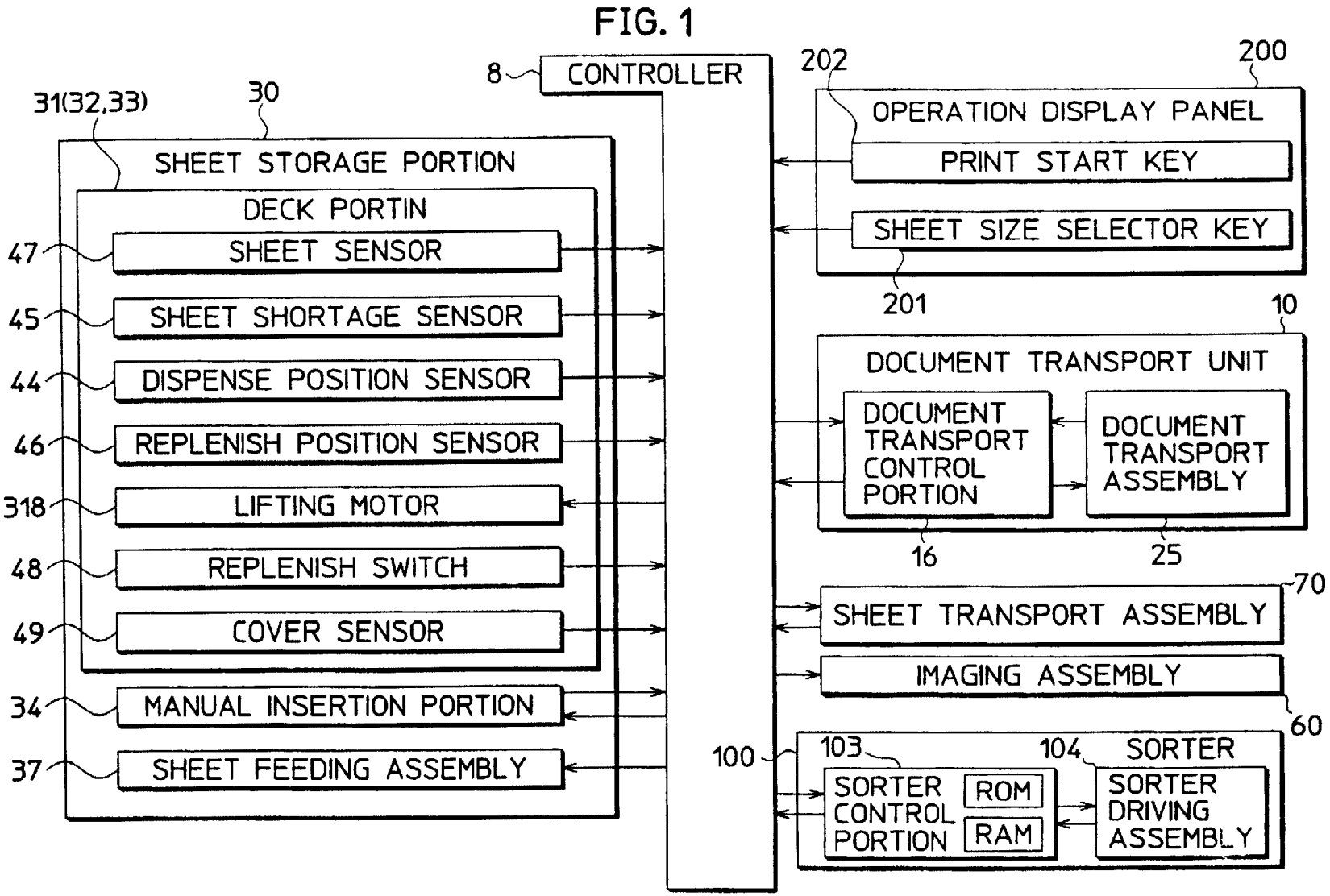
FIG. 1 is a block diagram of a control system of an embodiment of an image forming apparatus in accordance with the present invention.

A control system of the image forming apparatus of the present invention will be described with reference to a block diagram in FIG. 1.

The image forming apparatus comprises a controller 8 for controlling an overall operation of the apparatus main body 1, a document transport control portion 16 for controlling the document transport unit 10, and a sorter control portion 103 for controlling the sorter 100. The controller 8 serially communicates with the document transport control portion 16 and the sorter controller portion 103 by sending and receiving various data and operation timing signals to thereby control operation of the respective control portions.

The operation display panel 200 includes a copy sheet size selector key 201, print start key 202, various setting keys such as copy magnification setting key, and a display portion. With the copy sheet size selector key 201, the size of copy sheets is selected and the deck portion containing copy sheets of the selected size or the manual insertion portion is selected from among the deck portions 31, 32, 33 and the manual insertion portion 34. When the print start key 202 is depressed, a copying operation is started.

The document transport control portion 16 comprises a microcomputer internally provided with an ROM for storing a control program of the document transport unit 10 and an RAM for temporarily storing data. Further, the document transport control portion 16 controls various operations of a document transport assembly 25 comprising the document transport driving portion 12, transport belt 13, discharge roller 14 and document inverting portion 15 of the document transport unit 10.

The sorter control portion 103 comprises a microcomputer internally provided with an ROM for storing a control program of the sorter 100 and an RAM for temporarily storing data. The sorter control portion 103 controls various operations of a sorter driving assembly 104 comprising transport roller pairs in the sorter 100, the bin trays elevating mechanism, and the junction 101.

The controller 8 comprises a microcomputer internally provided with an ROM for storing a control program of the apparatus main body 1 and an RAM for temporarily storing data. When the print start key 202 is depressed, the controller 8 renders the apparatus main body 1 start a copying operation. The controller 8 controls various operations of the imaging assembly 60 and the sheet transport assembly 70 based on contents set by the various setting keys such as the magnification setting key.

The controller 8 controls various operations of the sheet storage portion 30 based on the contents set by the sheet size selector key 201 and has the following functions:

(1) The controller 8 controls the sheet sensor 47 to detect the absence of copy sheet. Further, when the sheet replenishment instruction switch 48 is depressed, the controller 8 drives the lifting motor 318 to lift the sheet support member 40 downward. Then, the controller 8 stops the driving of the lifting motor 318 upon the sheet replenishing position sensor 46 detecting that the sheet support member 40 is lifted downward to the sheet replenishing position.

(2) When a cover sensor 49 detects that the cover of the deck portion is closed, the controller 8 drives the lifting motor 318 to lift the sheet support member 40 upward. Upon the sheet dispense position sensor 44 detects that the sheet support member 40 is lifted upward to the sheet dispense position, the controller 8 stops the driving of the lifting motor 318.

When the print start key 202 is depressed, the controller 8 waits until the sheet dispense position sensor 44 detects that the sheet support member 40 is completely moved to the sheet dispense position in the case where the sheet support member 40 of the deck portion selected by the sheet size selector key 201 is being moved upward. Then, the controller 8 renders the apparatus main body 1 start a copying operation upon confirming that the sheet dispense position sensor 44 detects the sheet support member 40 and feeding of copy sheet is enabled.

Figure 5:
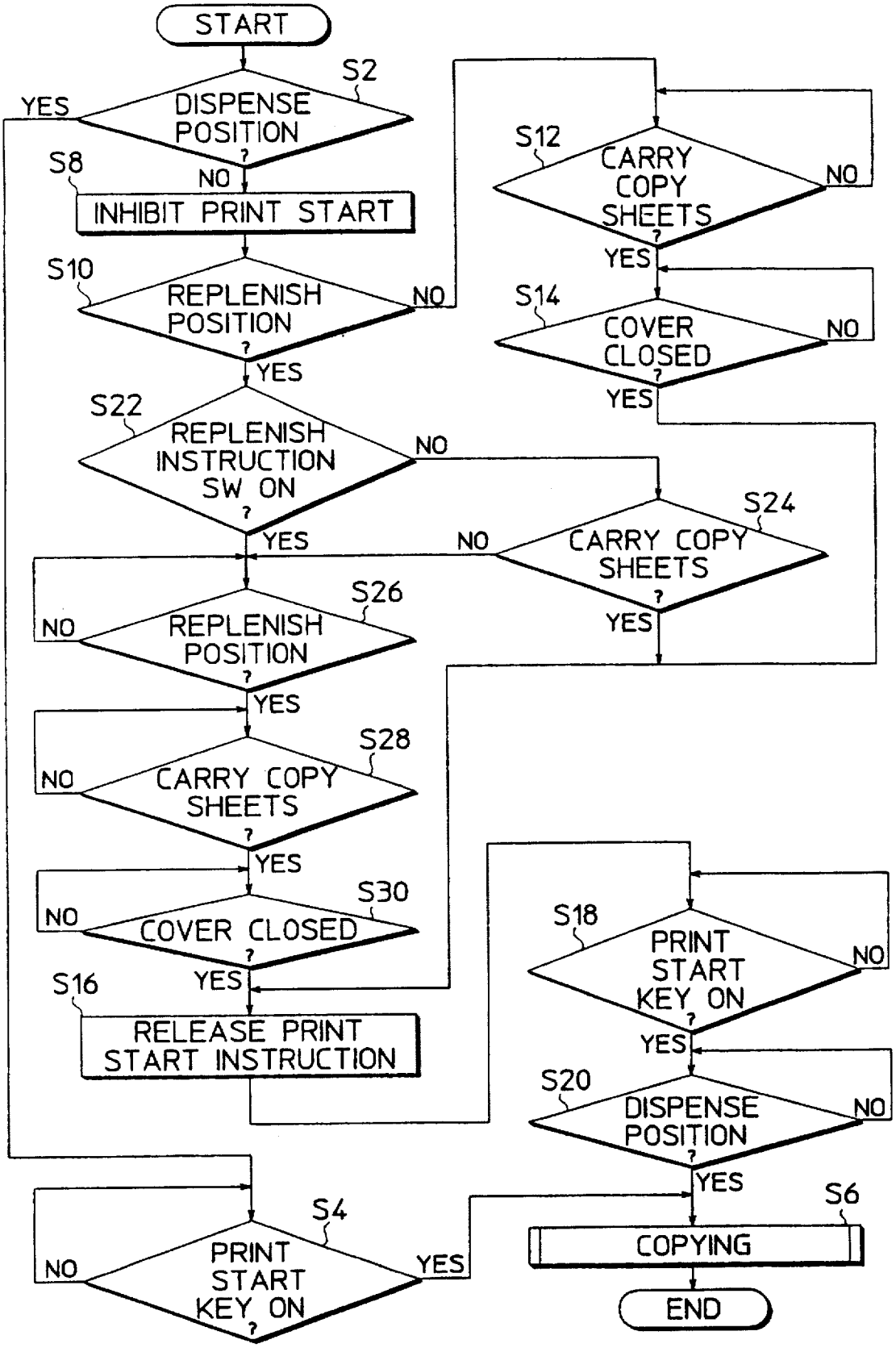
FIG. 5 is a flowchart showing a control operation of a controller of this embodiment.

A control operation of the controller 8 is described with reference to a flowchart in FIG. 5.

After the set contents on copying such as copy magnification are displayed on the operation display panel 200, and one of the deck portions 31, 32, and 33 is selected with the sheet size selector key 201, the control operation of the controller 8 is started. In this embodiment, described is the case where the deck portion 31 is selected with the sheet size selector key 201.

Upon start of the control operation, the controller 8 first discriminates whether the sheet support member 40 in the deck portion 31 is at the sheet dispense position (Step S2). The judgment in Step S2 is made based on the discrimination result as to whether the sheet dispense position sensor 44 detects the sheet support member 40. If the discrimination result in Step S2 is in affirmative, it is judged that the sheet support member 40 is at the sheet dispense position, namely, the deck portion 31 is in a normal state in which feeding of copy sheet to the apparatus main body is enabled. Then, it is discriminated whether the print start key 202 is depressed in Step S4. If the print start key 202 is depressed (YES in Step S4), a copying operation is started (Step S6).

On the other hand, if the discrimination result in Step S2 is in negative, i.e., in the case where the sheet dispense position sensor 44 does not detect the sheet support member 40 and hence it is judged that the sheet support member 40 is not in the sheet dispense position, the controller 8 inhibits the instruction of the print start key 202 (Step S8). Then, it is discriminated whether the sheet support member 40 is in the sheet replenishing position (Step S10). The judgment in Step S10 is made based on the discrimination result as to whether the sheet replenishing position sensor 46 detects the sheet support member 40.

If the discrimination result in Step S10 is in affirmative, i.e., it is judged that the sheet support member 40 is in the sheet replenishing position, it is then discriminated whether a stack of copy sheets are placed on the sheet support member 40 (Step S12). If a stack of copy sheets are not placed on the sheet support member 40 (NO in Step S12), this routine returns to repeat the judgment in Step S12. If a stack of copy sheets are placed on the sheet support member 40 (YES in Step S12), it is then discriminated whether the cover of the deck portion 31 is brought to a closed state from an opened state (Step S14).

If the cover sensor 49 detects the opened state of the cover (NO in Step S14), this routine returns to repeat the judgment in Step S14. Then, the controller 8 renders the apparatus main body wait in this state. If the cover is closed (YES in Step S14), the controller 8 drives the lifting motor 318 to start lifting the sheet support member 40 from the sheet replenishing position to the sheet dispense position, and releases the state that the print start key 202 is inhibited from being instructed (Step S16).

Subsequently, it is judged whether the print start key 202 is depressed (Step S18). If the print start key 202 is depressed (YES in Step S18), it is judged whether the sheet support member 40 is in the sheet dispense position (Step S20). If the discrimination result in Step S20 is in negative, i.e., the sheet support member 40 is on the way from the sheet replenishing position to the sheet dispense position, this routine returns to repeat the judgment in Step S20, thereby rendering the apparatus main body wait for a start of copying operation.

Then, if the sheet dispense position sensor 44 detects that the sheet support member 40 is in the sheet dispense position and it is confirmed that the sheet support member 40 has completely moved upward (YES in Step S20), the controller 8 allows the start of copying operation (Step S6).

On the other hand, if the discrimination result in Step S10 is in negative, this means that the sheet support member 40 is being moved downward or upward between the sheet dispense position and the sheet replenishing position. More specifically, this means that the sheet support member 40 is being moved downward from the sheet dispense position to the sheet replenishing position or vice versa. The control operation in this case is described hereinafter.

First, it is discriminated whether the sheet replenishment instruction switch 48 is depressed (Step S22). If the discrimination result in Step S22 is in negative, it is then discriminated whether the sheet support member 40 carries copy sheets thereon (Step S24). If the discrimination result in Step S24 is in affirmative, it is judged that the sheet support member 40 is on the way from the sheet replenishing position to the sheet dispense position, and the controller 8 releases the state that the print start key 202 is inhibited from being instructed (Step S16). Subsequently, as mentioned above, it is judged that the print start key 202 is depressed (Step S18). If it is judged that the print start key 202 is depressed (YES in Step S18), it is judged whether the sheet dispense position sensor 44 detects that the sheet support member 40 is in the sheet dispense position to confirm that the sheet support member has completely moved upward (Step S20). If the discrimination result in Step S20 is in affirmative, the copying operation is started (Step S6).

On the other hand, if the discrimination result in Step S22 is in affirmative, or the discrimination result in Step S24 is in negative, it is then judged that the sheet support member 40 is being moved downward from the sheet dispense position to the sheet replenishing position. Then, it is judged whether the sheet support member 40 has reached the sheet replenishing position (Step S26). If the discrimination result in Step S26 is in negative, this routine returns to repeat the judgment in Step S26, and the controller 8 renders the apparatus main body wait in this state until the sheet support member 40 reaches the sheet replenishing position. On the other hand, if it is judged that the sheet support member 40 is in the sheet replenishing position (YES in Step S26), it is then judged whether the sheet support member 40 carries a stack of copy sheets (Step S28). If the sheet support member 40 does not carry a stack of copy sheets (NO in Step S28), this routine returns to repeat the judgment in Step S28, and the apparatus waits in this state. If the deck portion is replenished with a stack of copy sheets on the sheet support member 40 (YES in Step S28), it is then judged whether the cover is brought to a closed state (Step S30). If the cover is not closed (NO in Step S30), this routine returns to repeat the judgment in Step S30, and the apparatus waits in this state.

If the cover is closed (YES in Step S30), this routine proceeds to Step S16 where the controller 8 drives the lifting motor 318 to start lifting the sheet support member 40 upward from the sheet replenishing position to the sheet dispense position, and releases the inhibited state of the print start key 202.

Subsequently, if the print start key 202 is depressed (YES in Step S18), as mentioned above, it is judged in Step S20 whether the sheet support member 40 is in the sheet dispense position based on the detection result of the sheet dispense position sensor 44. If it is confirmed that the sheet support member 40 has completely moved upward (YES in Step S20), the controller 8 allows the apparatus main body to start a copying operation (Step S6).

Upon start of the copying operation, a document is transported to a specified position on the document glass plate 7. Light emitted from the light source is reflected by a document placed on the document glass plate 7 to form an optical image from a document image, and the optical image is introduced to the lens unit 54 via the mirrors 53*a* to 53*c*. Thereafter, the optical image is exposed on a surface of the photosensitive drum 61 via the mirrors 53*d* to 53*f*.

At this time, the surface of the photosensitive drum 61 is uniformly charged by the main charger 62, and a specified area of the surface of the photosensitive drum 61 on which the document image is to be transferred is exposed to light emitted from the exposure lamp in the optical system 50 to form an electrostatic latent image. Subsequently, charged toner particles supplied from the developing unit 63 are attracted to the electrostatic latent image to thereby develop the latent image into a toner image.

On the other hand, a sheet of copy paper dispensed from the sheet storage portion 30 is transported by a sheet feeding assembly 37 in the sheet storage portion 30 (see FIG. 1) and then by the sheet transport assembly 70 to the registration roller pair 75. Then, the thus transported copy sheet is further transported downstream between the surface of the photosensitive drum 61 and the transferring/separating unit 64 by the registration roller pair 75 as timed with the operation of the optical system 50.

The transported copy sheet has the toner image formed on the surface of the photosensitive drum 61 transferred thereto and is separated therefrom by the transferring/separating unit 64. The copy sheet separated from the transferring/separating unit 64 is transported by the sheet transport belt 76 to the fixing unit 80 where the copy sheet has its toner image fixed to a surface thereof. The copy sheet after the fixing process is transported downstream by the sheet transport roller pair 77, and discharged to the sorter 100 by e.g., the sheet discharge roller pair 78.

With this construction, a copying operation can be instructed with the print start key 202 even if the sheet support member 40 is on the way from the sheet replenishing position to the sheet dispense position. Accordingly, an operator does not have to wait for the instruction to the print start key 202 until the sheet support member 40 has completely moved upward. In other words, the operator can depress the print start key 202 to instruct a copying operation immediately after a replenishing operation of copy sheets and thus can perform other tasks during the upward movement of the sheet support member 40 immediately after depressing the print start key 202. This is advantageous in improving the workability of the operator.

In the foregoing embodiment, if it is judged that the sheet support member in a selected deck portion is in the sheet dispense position, i.e., feeding of copy sheet is enabled in the selected deck portion, the instruction of copying operation for the selected deck portion is enabled with the print start key 202 regardless of the discrimination as to whether the sheet support member in other non-selected deck portion(s) is in the corresponding sheet dispense position. Accordingly, even if the sheet support member in the non-selected deck portion(s) is not in the sheet dispense position, a copying operation for copy sheets contained in the selected deck portion and a replenishing operation of copy sheets in the non-selected deck portion(s) can be performed simultaneously. Accordingly, the workability of an operator can be further improved.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An image forming apparatus for forming images on copy sheets, comprising:

an imaging engine for forming said images on said copy sheets;

a sheet storage mechanism having a sheet support member on which a stack of said copy sheets are supported;

said imaging engine having a copy sheet transport mechanism for transporting said copy sheets one by one from said sheet storage mechanism into said imaging engine;

a transport means for effecting movement of the sheet support member between a sheet replenishing position where said copy sheets are replenished and a sheet dispense position where said copy sheets are transportable one by one from said sheet storage mechanism to the imaging engine by said copy sheet transport mechanism;

a detector for detecting that the sheet support member is at the sheet dispense position;

an instructing device for generating an imaging instruction for instructing the imaging engine to perform an imaging operation;

a controller for applying said imaging instruction to effect said imaging operation by said imaging engine; and said controller including means for holding said imaging instruction during a period wherein said transport mechanism effects movement of the sheet support member from the sheet replenishing position to the sheet dispense position after receiving the imaging instruction until the detector detects that the sheet support member is at the sheet dispense position and for controlling the imaging engine to start the imaging operation upon the detector detecting that the sheet support member is at the sheet dispense position.

2. An image forming apparatus according to claim 1, further comprising a sheet sensor which detects a presence or an absence of a copy sheet on the sheet support member, wherein the controller includes means for inhibiting of the imaging operation when the sheet sensor detects the absence of a copy sheet on the sheet support member.

3. An image forming apparatus according to claim 1, wherein the sheet storage mechanism includes a plurality of sheet support members, the image forming apparatus further comprising a selector which selectively selects a particular sheet support member among the plurality of sheet support members, the controller holding the imaging instruction during movement of the selected sheet support member from the sheet replenishing position to the sheet dispense position, after receiving the imaging instruction, until the detector detects that the sheet support member has reached the sheet dispense position, and controlling the imaging engine to start the imaging operation upon the detector detecting that the sheet support member has reached the sheet dispense position.

4. An image forming apparatus for forming images on copy sheets, comprising:

an imaging engine for forming said images on said copy sheets;

a sheet storage mechanism having a sheet support member on which a stack of said copy sheets are supported;

said imaging engine having a copy sheet transport mechanism for transporting said copy sheets from said storage mechanism one by one into said imaging engine;

a transport means for effecting relative movement between the sheet support member and said copy sheet transport mechanism between a sheet replenishing position where said copy sheets are replenished and a sheet dispense position where said copy sheets are transportable one by one to the imaging engine by said copy sheet transport mechanism from the sheet storage mechanism;

a detector for detecting that the sheet support member and the copy sheet transport mechanism are at the sheet dispense position;

an instructing device for generating an imaging instruction for instructing the imaging engine to perform an imaging operation;

a controller for applying said imaging instruction to effect said imaging operation by said imaging engine; and said controller including means for delaying application of said imaging instruction received from said instructing device when said detector does not detect that the sheet support member and the copy sheet transport mechanism are at the sheet dispense position until said detector detects that the sheet support member and the copy sheet transport mechanism are at the sheet dispense position, and for applying said imaging instruction received from said instructing device, the application of which was delayed, to effect said imaging operation when said detector detects that the sheet support member and the copy sheet transport mechanism are at the sheet dispense position.

5. An image forming apparatus for forming images on copy sheets, comprising:

an imaging engine for forming said images on said copy sheets;

a sheet storage mechanism having a sheet support member on which a stack of said copy sheets are supported;

said imaging engine having a copy sheet transport mechanism for transporting of said copy sheets one by one into said imaging engine from the sheet storage mechanism;

a transport means for transporting the sheet support member between a sheet replenishing position where said copy sheets are replenished and a sheet dispense position where said copy sheets are transportable one by one from said storage mechanism to the imaging engine by said copy sheet transport mechanism;

a first detector for detecting that the sheet support member is at the sheet dispense position;

a second detector for detecting that the sheet support member is at the sheet replenishing position;

a third detector for detecting said copy sheets on said support member;

an instructing device for generating an imaging instruction for instructing the imaging engine to perform an imaging operation in response to operation of a start key;

a controller for applying said imaging instruction to effect said imaging operation by said imaging engine;

said controller including first means, responsive to said first detector, for determining whether the sheet support member is at the sheet dispense position and enabling response to said instructing device when it is determined that the sheet support member is at the sheet dispense position and disabling response to said instructing device when it is determined that the sheet support member is not at the sheet dispense position;

said controller including second means, responsive to said first, second, and third detectors, for enabling monitoring of said instructing device for operation of said start key when said sheet support member is not at said sheet dispense position and not at said replenishing position and said copy sheets are on said sheet support member;

said controller including third means, responsive to said first, second, and third detectors, for enabling monitoring of said instructing device for operation of said start key when said sheet support member is at said replenishing position and said copy sheets are on said sheet support member; and said controller including fourth means, responsive to said first detector, for effecting said imaging operation in response to said instructing device detecting operation of said start key during said monitoring of said instructing device and said sheet support member being at said sheet dispense position.

* * * * *